United States Patent [19]

Ryder et al.

[11] Patent Number: 4,599,968

[45] Date of Patent: Jul. 15, 1986

[54] COLLAPSIBLE PAINTING CART

[75] Inventors: Francis E. Ryder; Fred E. Williams, Jr., both of Arab, Ala.

[73] Assignee: Ryder International Corporation, Arab, Ala.

[21] Appl. No.: 737,816

[22] Filed: May 23, 1985

[51] Int. Cl.[4] ..... B05B 13/00

[52] U.S. Cl. ..... 118/305; 239/172; 239/176; 239/286; 239/302

[58] Field of Search ..... 239/150, 151, 172, 176, 239/286, 302; 118/305

[56] References Cited

U.S. PATENT DOCUMENTS

| | | | |
|---|---|---|---|
| 3,687,371 | 8/1972 | Swager | 239/150 |
| 3,796,353 | 3/1974 | Smart | 239/150 |
| 3,871,557 | 3/1975 | Smart | 239/150 |
| 4,262,821 | 4/1981 | Smart | 239/172 X |

FOREIGN PATENT DOCUMENTS

| | | | |
|---|---|---|---|
| 24769 | 3/1981 | European Pat. Off. | 239/150 |

*Primary Examiner*—Shrive P. Beck

*Attorney, Agent, or Firm*—Trexler, Bushnell & Wolters, Ltd.

[57] ABSTRACT

A collapsible painting cart apparatus comprises a mobile frame, a receptacle for receiving a container of paint, and an extendable and retractable mounting and guide member for mounting the receptacle and for guiding the direction of paint released from the container. The mounting and guide member is mounted to the frame for movement between a first position extended from the frame for applying paint to a desired surface and a second position retracted within the frame for storage. A handle is attachable to the frame and extendable outwardly therefrom for gripping by an operator to propel the mobile frame relative to the desired surface.

Preferably, the receptacle-mounting and guide member mounts the receptacle in such a way as to guide the direction of the paint released from the container generally forwardly of the mobile frame, and a second, outboard receptacle-mounting and guide member is selectively mountable to extend generally laterally outwardly of the first guide member for alternatively mounting the receptacle in such a way as to guide the direction of paint released from the container received therein generally laterally outwardly of the frame member, so as to permit application of paint to, or closely adjacent to, a vertical surface which is closely laterally adjacent to the mobile frame.

Preferably, one or both of the mounting and guide members orients the container for depositing a stripe of paint or a selectable width, and further includes an arrangement for selecting the width of the paint stripe.

24 Claims, 12 Drawing Figures

130
36b
122
26
28c
28b
28a
131
29
37
121
112
44
90
92
83
82
80
52
84
42

30
20
22
38
25
26
24
28
48
172
40
40a
11
130
12
146
140
144
54
34
36b
102
106
166
122
120
28b
140
112
25
26
36a
94
128
32
50
98
36c
108
46
36b
122
130
124
142
146
144
140
134
126

COLLAPSIBLE PAINTING CART

BACKGROUND OF THE INVENTION

This invention is directed generally to paint-applying apparatus, and more particularly to a novel collapsible or knock-down painting cart, movable over a surface for applying paint in a desired pattern on desired portions of adjacent surfaces.

In many instance, it is desirable to apply stripes, patterns or other markings to ground and/or floor surfaces. For example, various stripes and patterns are applied to athletic fields or to parking lots, to factory or warehouse floors, and often to adjacent vertical surfaces as well. In this latter regard, it is often desirable to paint vertical surfaces of adjacent walls near corners or the like in factories or warehouses. Similarly, in parking lots it is often desirable to paint surfaces of relatively low curbs or other parking barriers. It may be additionally desirable to apply various symbols, markings, names or the like to the parking barriers or curbs. Moreover arrows, directions such as the words "IN" or "OUT", "NO PARKING" or the like may also be applied to appropriate portions of the parking lot surfaces, curbs or parking barriers, or other surfaces.

Heretofore, such stripes have been applied by relatively expensive and complicated striping machinery, while such other markings have generally been applied by hand with the use of suitable stencils and spray painting equipment. Some attempts have been made to provide a relatively small and inexpensive wheeled cart or cart-like apparatus for manually applying a continuous strip or stripe of paint to a ground or floor surface. However, this prior apparatus generally comprised a four-wheeled, solid-bodied cart which mounted a single spray paint container substantially centrally of the four wheels. This container was mounted pointed or aimed downwardly to distribute the paint to a surface generally centrally located beneath the cart itself. This striping cart also provided pairs of "masking" wheels having various spacings therebetween and mountable to the cart to roll on the ground or floor to either side of the paint outlet to control the width of the stripe.

The foregoing arrangement suffers from a number of problems. Initially, the volume of paint accommodated within a single spray-paint type of container is relatively small, such that the above-described cart arrangement requires relative frequent stoppage of work to replace the container. When working in a relatively large factory, parking lot or the like, it will be appreciated that substantial time may be spent in returning to a carton or other supply of containers each time a new container is needed. Similarly, the requirement of attaching a different set of masking wheels for each width of stripe to be applied is relatively messy, cumbersome and time-consuming.

Moreover, the arrangement of a relatively solid-bodied cart with the container received essentially centrally therethrough does not permit the operator to observe the paint as it is being applied. Hence, any irregularity in the desired stripe or pattern, inadequate paint application, or exhaustion of the paint supply will not be immediately seen by the operator. Hence, the operator must carefully repeat the application to the problem area, taking care to blend it in with the properly painted areas to either side thereof. Needless to say, such repainting or retracing can be relatively time-consuming.

Additionally, it is desired in many instances, as noted above, to apply some amount of paint to some vertical surfaces, curbs, parking barriers or the like. The prior art arrangement is not capable of application of paint to any vertical surface. Additionally, it may be desired to apply a stripe or pattern relatively closely to a vertical surface. However, the arrangement described above relases the paint substantially centrally of the cart and between the wheels thereof. Hence, it is not possible with this prior art arrangement to apply paint relatively closely to a vertical surface, such as at a corner formed by a horizontal floor and an adjacent vertical wall, for example.

Moreover, the above-described prior art painting cart structure comprised a generally unitary one-piece body having a handle rigidly attached thereto and projecting generally upwardly and rearwardly thereof. This structure is relatively bulky and space-consuming, hence making packaging for shipping difficult, for example. Moreover, the essentially one-piece construction makes storage and/or transport of the prior art painting cart relatively difficult, due to the relatively large amount of space required for the cart and projecting handle.

OBJECTS AND SUMMARY OF THE INVENTION

Accordingly, it is a general object of the present invention to provide a novel and improved painting cart which substantially overcomes the above-described problems.

A more specific object is to provide a painting cart in accordance with the foregoing object which may be partially disassembled and/or collapsed into a relatively small volume to facilitate packaging, shipping, storage, transport and the like.

A related object is to provide a painting cart in accordance with the foregoing objects which mounts a paint container such that the application of paint to a surface takes place within full view of the operator at all times A further object is to provide a painting cart which is capable of selectively varying the width of a paint stripe deposited by varying the height at which a paint container is carried thereupon.

A further object is to provide a painting cart in accordance with the foregoing objects which is capable of carrying a supply of paint containers thereupon for ready replacement of containers with minimal interruption of the work.

A further object is to provide a painting cart which is capable of applying paint substantially to or along vertical surfaces adjacent the horizontal surface of travel.

A related object is to provide a painting cart in accordance with the foregoing object which is capable of applying paint along a horizontal surface relatively closely to an adjacent vertical wall or surface, or along and to the corner defined by the two surfaces, or along and to only one of the horizontal or vertical surface, as desired.

A related object is to provide a paint cart in accordance with the foregoing objects which is relatively simple and inexpensive in its design and manufacture and yet highly reliable in operation.

In accordance with one aspect of the invention, a collapsible painting cart apparatus comprises a mobile frame; receptacle means for receiving a container of paint; an extendable and retractable mounting and guide member for mounting said receptacle means and for guiding the direction of paint released from the container received by said receptacle means, said mounting and guide member being mounted to said frame for movement between a first position extended from said frame for applying paint to a desired surface and a second position retracted within said frame for storage; and handle means attachable to said frame and extendable outwardly therefrom for gripping by an operator to propel said mobile frame relative to said desired surface.

In accordance with another aspect of the invention, a painting cart apparatus comprises a mobile frame; a receptacle member for receiving a container of paint; a receptacle-mounting and painting directional guide member for mounting said receptacle in such a way as to guide the direction of the paint released from the container generally forwardly of said mobile frame; and a second, outboard receptacle-mounting and painting directional guide member selectively mountable to extend generally laterally outwardly of said first guide member for alternatively mounting said receptace in such a way as to guide the direction of paint released from the container received therein generally laterally outwardly of said frame member, so as to permit application of paint to, or closely adjacent to, a vertical surface which is closely laterally adjacent to said mobile frame.

In accordance with yet another aspect of the invention, a paint cart apparatus comprises a mobile frame; receptacle means for receiving a container of paint; and a mounting and guide member for mounting said receptacle means and for guiding the direction of paint released from the container received by said receptacle means; said mounting and guide member further including mounting means for mounting said receptacle and a container received therein for depositing a stripe of paint of a selectable width, said mounting means including means for selecting said selectable width of said paint stripe.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings, in which like reference numerals identify like elements, and in which:

FIG. 6 is a perspective view illustrating the fully collapsed condition of the collapsible painting cart of the invention for shipment, transport, storage or the like;

DETAILED DESCRIPTION OF THE ILLUSTRATED EMBODIMENT

Figures 1, 11, 12:
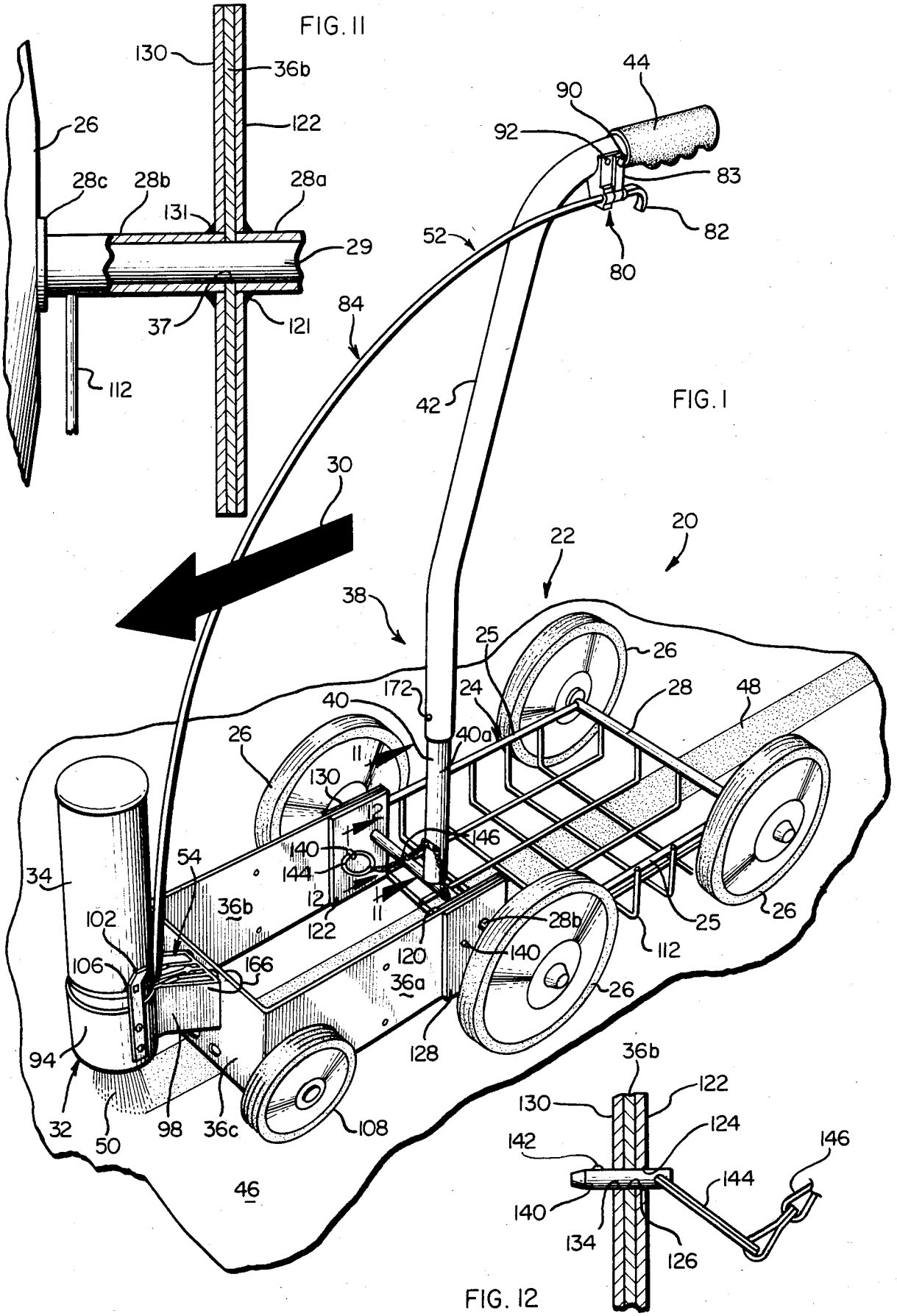
FIG. 1 is a perspective view of a fully assembled collapsible painting cart in accordance with the invention applying a strip or stripe of paint to a horizontal surface.
FIG. 11 is an enlarged partial view, partly broken away and partly in section, taken generally along the line 11—11 of FIG. 1.
FIG. 12 is an enlarged partial view, partly in section, and taken generally along the line 12—12 of FIG. 1.

Referring now to the drawings, and initially to FIGS. 1 through 6, a collapsible painting cart in accordance with the invention is designated generally by the reference numeral 20. The cart 20 comprises a mobile frame 22 which will be seen to comprise a generally rectilinear frame member 24 and a plurality of wheels 26 rotatably coupled thereto. In the illustrated embodiment, the wheels 26 on the frame are four in number and are coupled for rotation in parallel planes to a pair of transverse axle members 29. These axles 29 extend thrugh tubular members or sleeves 28 which form front and rear end portions of the frame 24 (see FIG. 11). Hence, the cart is movable upon the wheels 26 in a generally straight line as indicated by arrow 30 in FIG. 1, the wheels 26 being non-pivotally mounted relative to frame 24 for maintaining this generally straight line of travel. The tubular end member or sleeves 28, together with rod-like side rail members 25 define the rectilinear frame 24. Preferably members 25 and 28 ae joined by welding, soldering or other suitable means.

Figure 2:
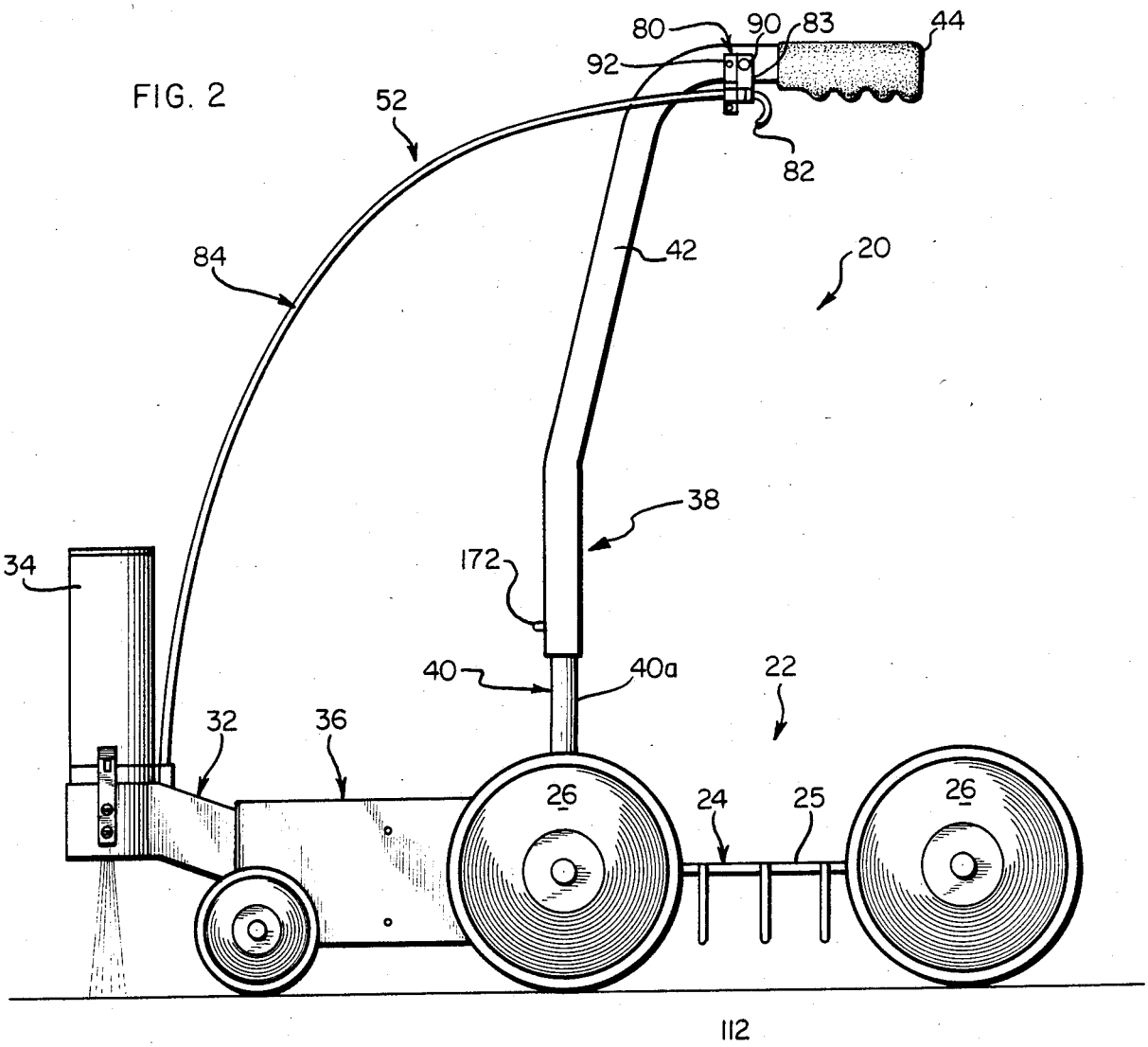
FIG. 2 is a side elevation of the painting cart of FIG. 1.
Figure 3:
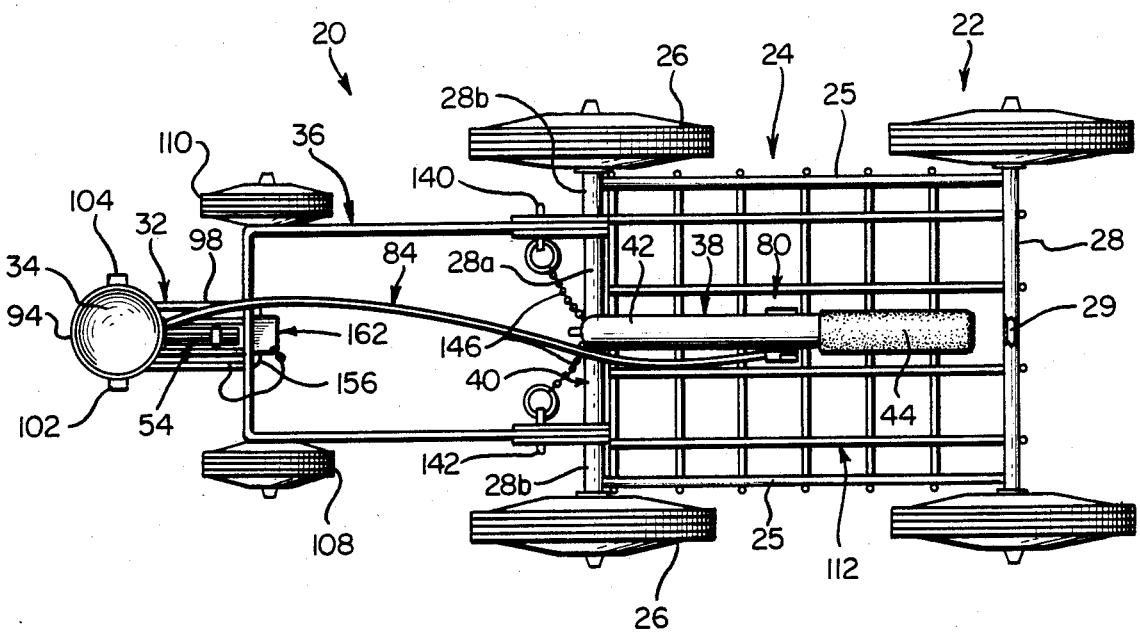
FIG. 3 is a top plan view of the painting cart of FIGS. 1 and 2.
Figure 6:
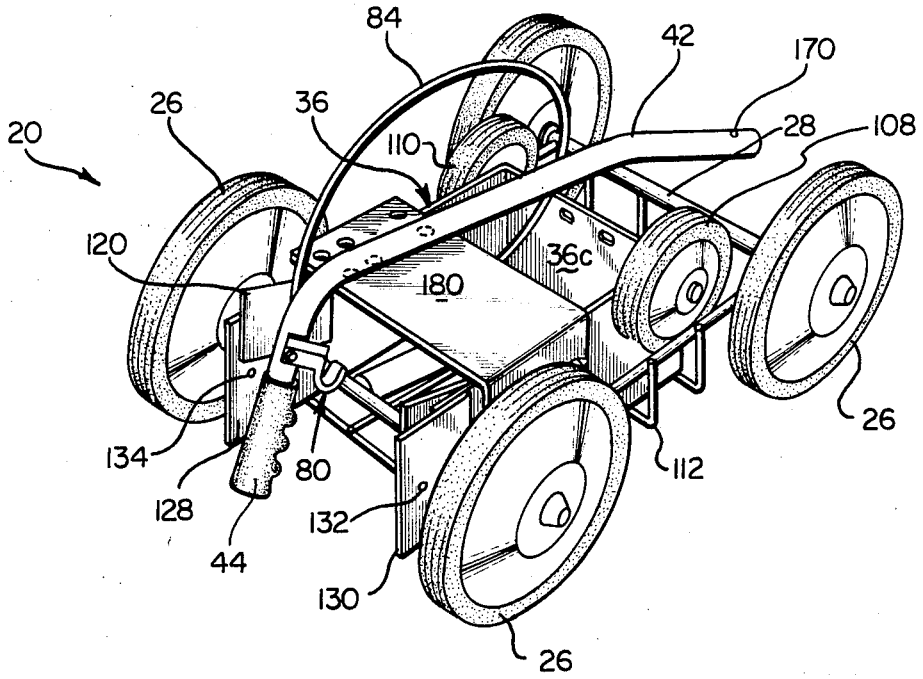
Figure 5:
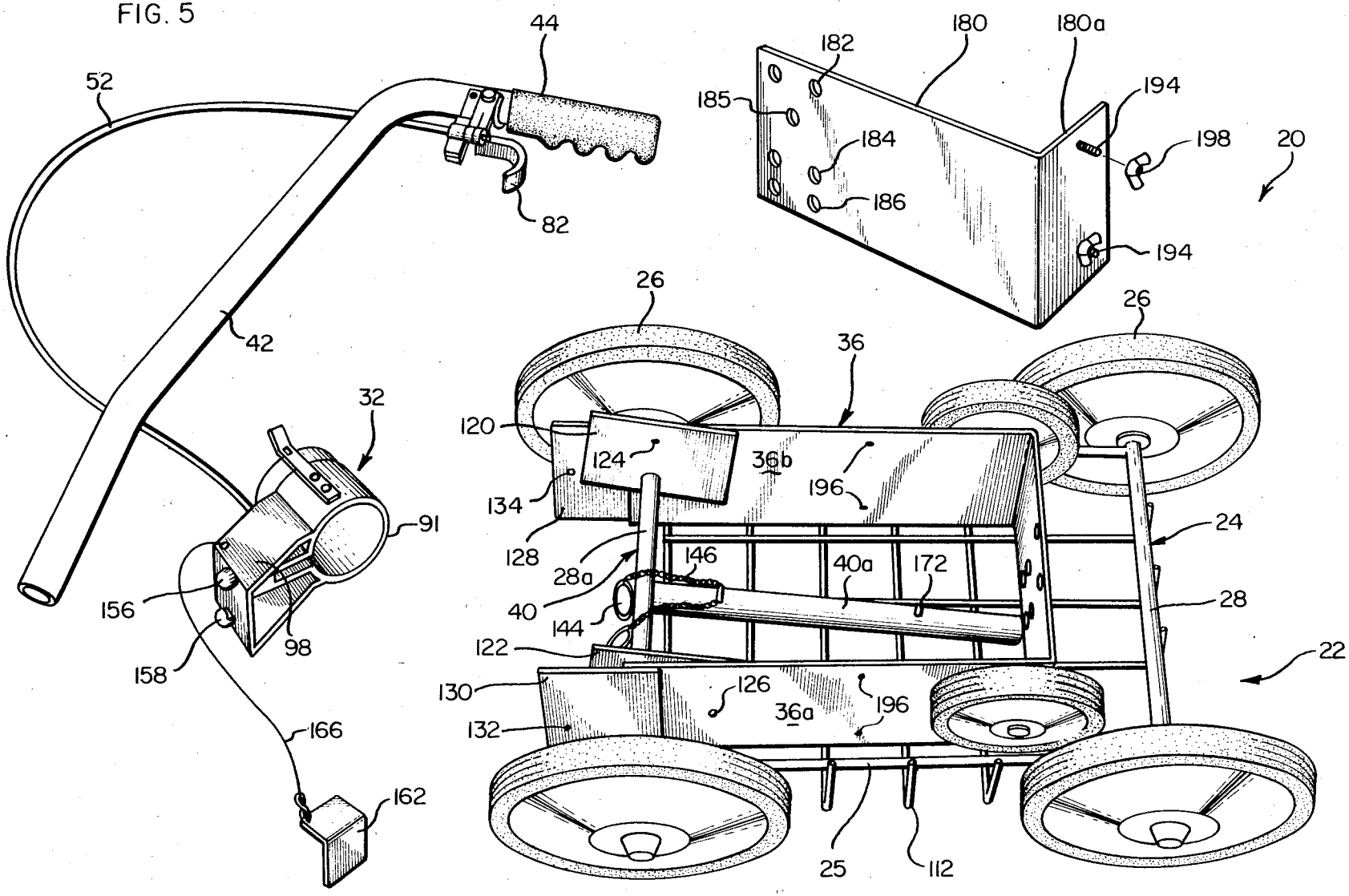
FIG. 5 is an exploded perspective view, further indicating disassembly and collapsing of the collapsible painting cart of the invention.

A receptacle or receptacle means 32 is provided for receiving a spray can or container 34 of paint and mounting said can 34 in position on the cart. An extendable and retractable mounting and guide member 36 is provided for mounting the receptacle 32 in such a way as to guide the direction of paint released from the container 34 received therein. This mounting and guide member 36 is pivotally mounted to the frame 22 for movement between a first position, as illustrated in FIGS. 1 through 3, extended from the frame for applying paint to a desired surface and a second position, as illustrated in FIGS. 5 and 6, retracted within the frame 22 for storage. The member 36 is comprised of a pair of side walls **36*a* and 36*b*, and a front wall 36*c* to which the receptacle 32** is mounted.

A handle structure or handle means 38 is attached to the frame 22 and extends generally upwardly therefrom for gripping by an operator to propel the frame relative to the ground or a floor surface 46 to which it is desired to apply paint. This handle structure or handle means 38 comprises an extendable and retractable, pivotally mounted handle base portion 40 which is mounted to the frame 22 for pivotal movement between a working position extended relative to the frame, as viewed in FIGS. 1 through 3, and a storage position retracted for storage within the frame, as shown in FIGS. 5 and 6.

A second, handle extension member or portion 42 is mountable to the handle base portion 40 when the latter is in its working position. This handle extension portion 42 terminates in a grip or grip means 44 for gripping by an operator to propel the cart in the direction 30, or in the opposite direction if desired. In the configuration illustrated in FIGS. 1 through 3, that is, with the receptacle 32 mounted generally at a front end of the fully extended mounting and guide member 36, and with the handle 38 including extension 42 fully extended, paint may be applied from the container 34 to the floor or ground surface 46 generally beneath the cart. This application of paint from container 34 will take the form of a straight strip or stripe 48 generally centered between wheels 26, with the container 34 releasing the paint in a generally fan-shaped spray pattern as indicated at 50.

Figure 10:
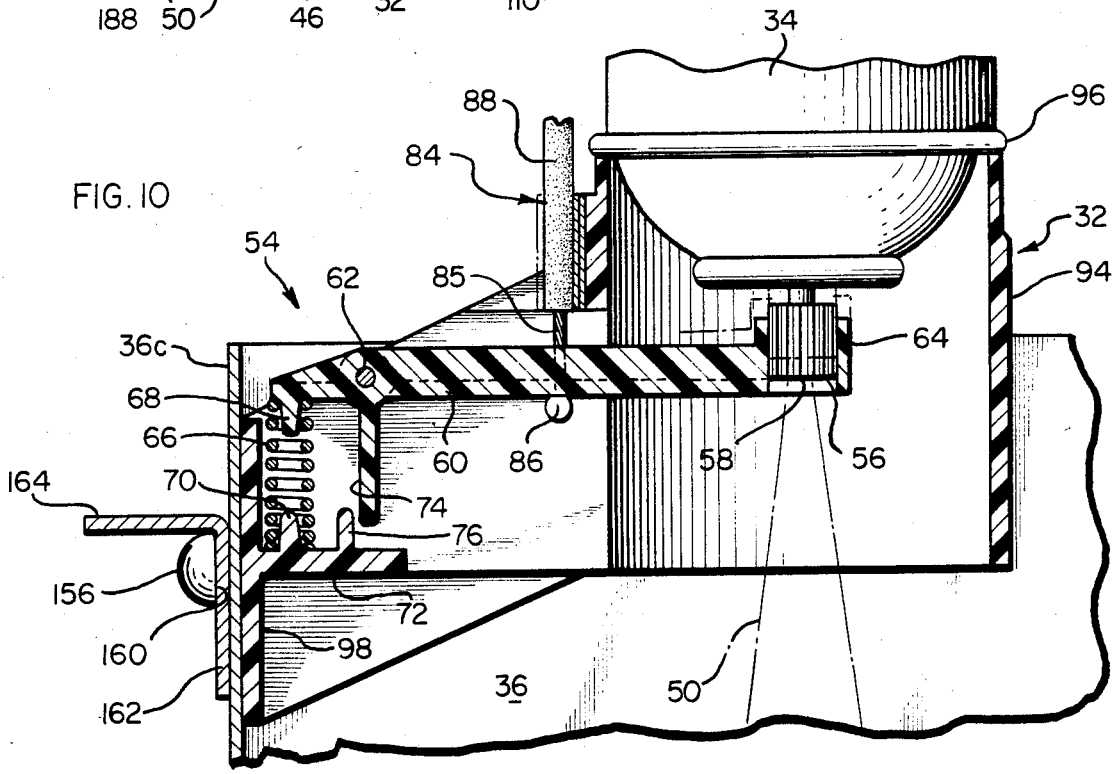
FIG. 10 is an enlarged partial sectional view taken generally in the plane of the line 10—10 of FIG. 7.

In order to control the release of paint from the container 34, a selectively actuatable paint release control or control means, designated generally by reference numeral 52, is provided. Referring also to FIG. 10, the paint release control means includes a controller portion 54 coupled with the receptacle means 32 for controlling the release of paint from the container 34 received therein. In this regard, the container 34 will be seen to comprise a generally cylindrical spray-type container having a spray head or button portion 56 with an aperture 58 directed generally axially downwardly with respect to the container 34, as viewed in FIG. 10. Depression of the head or button 56 relative to container 34 will result in release of paint from the container 34 and through aperture 58.

Accordingly, the controller 54 is adapted to provide a suitable generally inward pressure on button 56 with respect to container 34. To this end controller 54 comprises an elongate arm member 60 pivoted about a pivot comprising a pin or shaft 62 near one end thereof and having a button engaging sleeve 64 of complimentary dimensions for surroundingly engaging button 56 at an opposite end thereof. The controller will be seen to be normally biased by a compression spring 66 at an end of the arm 60 opposite the sleeve 64 into a non-working position, wherein paint is not released from the container. The spring 66 is a coil compression spring engaged between a pair of projecting fingers 68, 70. Finger 68 is formed at an end of arm 60 opposite sleeve 64, while finger 70 is formed on an inwardly extending bracket-like portion 72 of the receptacle member 32.

In order to hold the arm 60 substantially in the position illustrated in FIG. 10 and prevent further pivotal movement thereof in response to the biasing spring 66, a pair of stop or abutment members 74, 76 are also provided. The first stop 74 comprises a finger protruding generally normally to arm 60 from the area of pivot 62, while cooperating stop or abutment surface 76 comprises a second finger projecting upwardly from surface 72.

The paint release control means 52 also includes an actuator portion or assembly 80 mounted to the handle portion 42 adjacent grip 44 for selective actuation by the operator for causing the controller portion 54 to initiate and terminate release of paint from the receptacle as desired. In the illustrated embodiment, this actuator portion includes a trigger member 82 mounted by means of a bracket 83 to the handle extension 42 adjacent grip 44 and an elongate cable 84 extending therefrom to the controller 54. Referring again to FIG. 10, the cable 84 is preferably of the shielded or protected type, including an outer shield or sleeve member 88 about an inner cable member 85. Cable member 85 is coupled to arm 60 at a point thereof generally intermediate the pivot 62 and sleeve 64. In the illustrated embodiment, a through aperture or slot 86 may be provided in arm 62 receive cable 84 therethrough and an enlarged knob-like head or end portion 86 may be provided at an end of cable 85 to retain it within the through aperture or slot provided in arm 60.

Hence, the trigger 82 is rigidly mounted or attached to bracket 83 which is pivotally mounted to handle portion 42 by a pivot pin 90. However, the cable 84 is preferably non-pivotally or rigidly mounted to handle 42 by a bracket 92. Hence, trigger 82 may be pulled generally backwardly with respect to direction 30 to thereby pull cable 84 generally upwardly (as viewed in FIG. 10) to accomplish actuation of controller 60 and release of paint from container 34. Preferably, bracket 92 extends rearwardly and pivot pin or shaft 90 of bracket 83 extends therethrough so as to maintain the trigger 82 and the end of cable 84 affixed to bracket 92 in a predetermined alignment.

Referring again to FIG. 10, receptacle member 32 will be seen to comprise a first or container-engaging portion 94 which comprises a generally cylindrical member of similar diameter to the cylindrical container 34 and arranged for surroundingly engaging a projecting lip portion 96 near one end of container 34. A mounting bracket portion 98 of receptacle 32 will be seen to extend laterally outwardly integrally from mounting sleeve portion 94 to engage the mounting and guide member 36. As best viewed in FIG. 7, a pair of resilient leaf spring-like gripping fingers 102, 104 are coupled to opposite sides of mounting sleeve portion 94 for engaging the container 34. These leaf spring-like fingers 102, 104 preferably include similar, inwardly projecting portions or tabs 106 for engaging the lip 96 at the edge thereof opposite its engagement with an upper edge of sleeve portion 94. In this regard, top portions of spring-like members 102, 104 are flared generally outwardly to facilitate both engagement and release of tabs 106 with respect to rim 96.

It will be noted that the painting cart, when in its fully extended or working position, as viewed in FIGS. 1 and 3 for example, provides full view to the operator of the application of paint stripe 48 at all times. In this regard, mounting and guide member 36 will be seen to comprise a generally open U-shaped member having no substantial horizontal surfaces obstructing an effective view of paint stripe 48 therebelow.

Referring now again to FIGS. 1 through 6, the manner in which the collapsible painting cart may be collapsed from the position indicated in FIGS. 1 through 3 to the position indicated in FIG. 6 will next be described. In this regard, it will be seen that the mounting and guide member 36 also includes at least one wheel, and preferably a pair of wheels 108, 110 which are mounted thereto for rotation in a single plane, parallel to the planes of rotation of the wheels 26 of the mobile frame. These latter wheels 108, 110 will be seen, for example in FIG. 3, to be laterally spaced apart by a distance less than the lateral spacing between wheels 26. The mobile frame 24 will also be seen to mount a generally basket-like member or portion 112 suitable for carrying a supply of paint containers such as container 34 therein. This basket-like member or portion 112 will be seen to comprise a plurality of generally orthogonally disposed rods or strips of material arranged in a grid-like pattern and suspended from the four forming frame 24 members including axle-receiving tubular members 28 and side rail members 25. It will be noted that FIGS. 4 and 5 further illustrate intermediate steps the collapsing procedure. In this regard, the mounting and guide member 36 will be seen to be pivotally mounted to the mobile frame member for movement between its first or extended position as illustrated in FIGS. 1 through 3 and its second or storage position as illustrated in FIGS. 5 and 6. Similarly, the handle means and more particularly base portion 40 thereof is pivotally mounted to the mobile frame for movement between its working position as shown in FIGS. 1 through 3 in its storage position as shown in FIGS. 5 and 6.

Moreover, both handle base portion 40 and mounting and guide member 36 will be seen to be pivotally mounted about a common transverse axle 29 at one of tubular members 28 of the mobile frame 22, which axle 29 also mounts a pair of the wheels 26 at opposite ends thereof and to either side of the frame member 24, as previously indicated. The mounting and guide member 36, as metnioned comprises, a generally U-shaped member defined by forming a generally flat, sheet-like elongate strip of material by bending or otherwise. (In this regard, the member 36 preferably comprises a metallic material. Similarly, the frame 24, tubular axle-receiving members 28 and basket-like member 112 are preferably formed from a metallic material and therefore are held together by welding or soldering). The U-shaped mounting and guide member 36 is pivotally or rotatably mounted to front axle 29 at through bearing apertures 37 (see FIG. 11), aligned at opposite side surfaces 36*a*, 36*b* thereof.

In this regard, the front tubular member or sleeve 28 is broken into three segments, with a first or middle sleeve segment 28*a* thereof being soldered or welded or otherwise coupled with a tubular member 40*a* to define the handle base member or portion 40. Opposite ends of this sleeve segment 28*a* are further coupled by welding or soldering, as indicated at 121 (FIG. 11), to a pair of similar rectilinear flat plates 120, 122, each of which includes a through aperture 124. These plates 120, 122 and through apertures 124 also comprise a part of the handle alignment means for holding the mounting and guide member 36 and the handle base base portion as well as defining portion 40 in a predetermined alignment relative to each other and to the frame member 22 when the guide member is in its first position and the handle base portion 40 is in its upright or working position as illustrated in FIGS. 1 through 3. These alignment means further includes additional through apertures 126 in the opposite side surfaces 36*a*, 36*b* of mounting and guide member 36 (see FIG. 5).

Cooperatively, the frame member 22 (and particularly front tubular member 28) mounts a further pair of flat, rectilinear plates 128, 130, similar to the plates 120 and 122. In this regard, these plates 128, 130 are held preferably by welding or soldering, as indicated at 131 (FIG. 11), to respective laterally outer portions 28*b* of the tubular or sleeve member 28 at the front of the cart as viewed in FIG. 1. Final, outer end parts 28*c* (See FIG. 11) of both members 28 are flared out to bear against the wheels 26 coupled to the axles 29 running therethrough. Moreover, as best viewed in FIG. 11, plates 120 and 128 on the one side and 122 and 130 on the other side receive end portions of walls 36*a* and 36*b* generally sandwiched therebetween and engaged about shaft 29 as previously mentioned. Hence, the respective plates 120, 128 and 122, 130 and the end surfaces of sidewalls 36*a* and 36*b* are movable into closely adjacent, facing relation upon pivotal movement of the mounting and guide means 36 and the handle base portion 40 relative to the frame member 22 to the posisiont shown in FIGS. 1 thrugh 3.

These plates 128 and 130 also have mutually aligned through apertures 132, 134 (see FIG. 5) which are also alignable with the previously mentioned through apertures 124 and 126 when the cart is in its working or extended position as illustrated in FIGS. 1 through 3. Hence, upon pivotal movement of the mounting and guide member 36 and the handle portion 40 including the plates 120 and 122 thereof to the position illustrated in FIGS. 1 through 3, the respective through apertures in all of the above-mentioned surfaces are brought into alignment to receive a pair of retaining pins or pin means 140 (see FIGS. 11 and 12).

Referring briefly to FIG. 12, the engagement of pin 140 through the aligned through apertures of plates 122 and 130 and wall 36*b* is illustrated. The pin 140 will be seen to have a pair of spaced apart stops or stop means thereon for resisting any forces which might otherwise tend to dislodge the pin from the align through apertures once inserted therethrough. These stop means comprise a protruding, retractable detent or detent means 142 toward one end of the pin 140 and a coupling ring or means 144 toward an opposite end of the pin 140. This later coupling means or ring 144 is of greater dimension than the diameters of the through apertures 124, 126 and 134. Ring 144 further receives an elongate flexible means or member, here illustrated as a chain link member 146, the opposite end of which is coupled to the handle base portion 40 as best viewed in FIGS. 1 and 3. This arrangement retains the pins 140 against loss and readily accessible for insertion, when desired, through the aligned apertures for holding the cart in its extended or working position illustrated in FIGS. 1 through 3.

Figure 7:
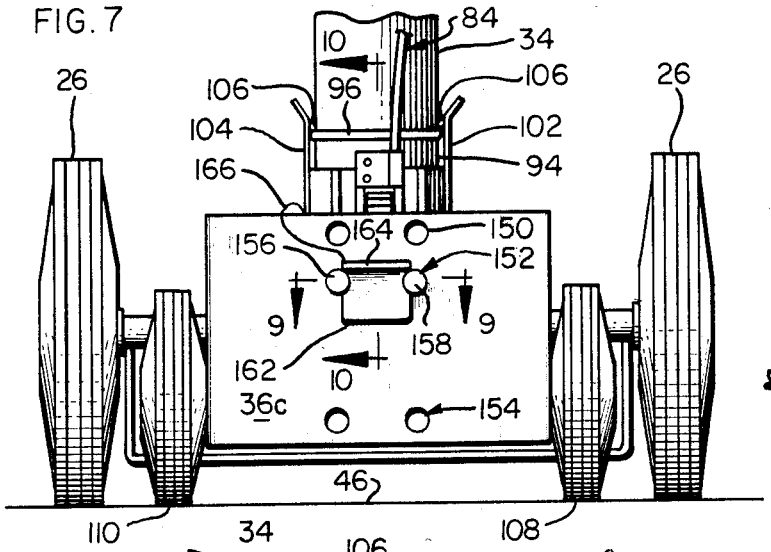
FIG. 7 is a partial front elevation of the assembled painting cart, illustrating an alternative positioning of a paint container thereupon.
Figure 9:
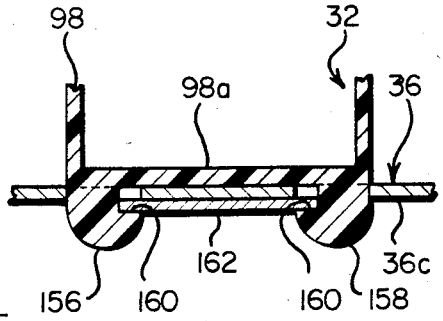
FIG. 9 is an enlarged partial sectional view taken generally in the plane of the line 9—9 of FIG. 7.

Referring now also to FIGS. 7 and 9, the mounting and guide member 36 includes mounting means in the front plate 36*c* for mounting the receptacle and container laterally intermediate the wheels 26 of the frame and also intermediate the wheels 108, 110. In the illustrated embodiment, these mounting means include a plurality of pairs of through holes or apertures 150, 152 and 154 formed in the front plate 36*c* and located at different respective vertical elevations or heights with respect to the ground or floor surface 46. These apertures are aligned for cooperatively receiving a pair of similarly aligned projecting members or projections 156, 158 which project outwardly from the mounting bracket portion 98 of the receptacle member 32, as best viewed in FIG. 9. The projecting members 156 and 158 project from a generally flat end surface portion 98*a* of mounting bracket portion 98, which thereby abuts the generally flat front or end wall 36*c* of member 36. The receptacle is thus positioned by selecting one of the spaced pairs of apertures 150, 152 or 154 to receive the cooperating projecting members 156 and 158. The container 34 and particularly previously mentioned spray button 56 thereof are thereby oriented substantially vertically downwardly for depositing a stripe of paint between the wheels 108, 110 and wheels 26.

Importantly, it will be seen that the described mounting means provide means for selecting a selectable width of the stripe of paint deposited. That is, the apertures 150, 152 and 154 are respectively provided at different vertical elevations or heights, so that the fan-like pattern of paint 50 will cover a progressively broader or wider area as the receptacle, and hence the container, is mounted progressively higher with respect to the surface 46.

Figure 8:
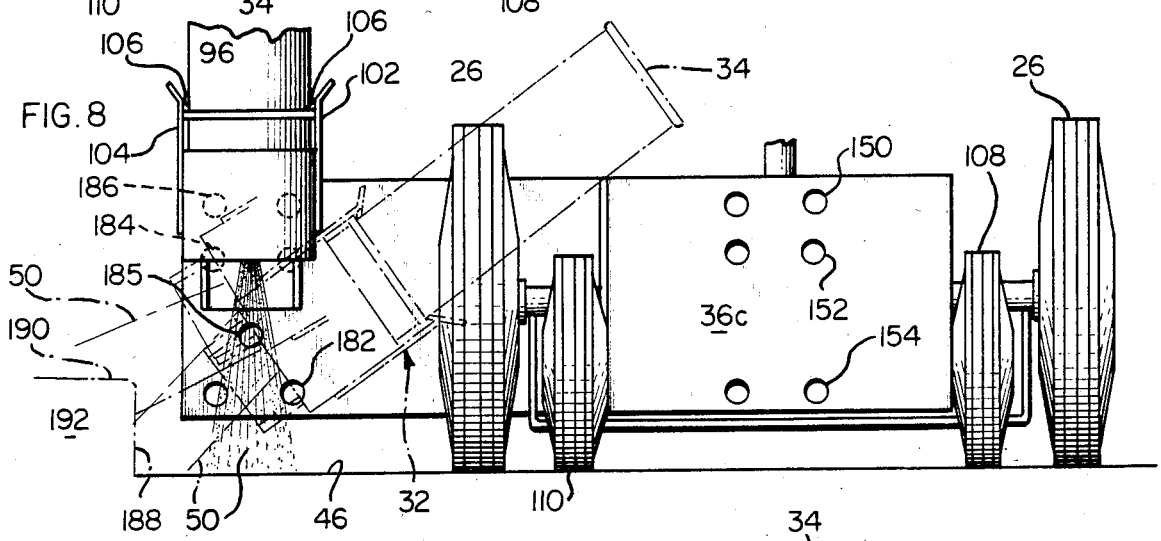
FIG. 8 is a front elevation, similar to FIG. 7, and illustrating the assembly of a further portion of the painting cart for outboard or angular mounting of a spray paint container.

As best viewed in FIGS. 8 and 9, in order to hold the receptacle 32 to the mounting member 36 at the selected pair of apertures 150, etc., a pair of undercut portions 160 are provided in respective projecting members 156 and 158 for cooperating with a generally flat, L-shaped retaining plate or key member 162. As best viewed in FIGS. 8 and 9, these undercut portions 160 project generally outwardly of or through the selected pair of apertures 150, etc. of mounting member front wall 36*c*. Accordingly, the plate 162 is of sufficient width engage both of the undercut portions 160 while abutting the surface of the wall 36*c*. The bent-over upper portion 164 of the L-shaped retaining member or plate 162 may be pressed downwardly until it abuts top surfaces of projections 156 and 158, thereby retaining the bracket 98 and hence receptacle 32 and container 34 in the selected position relative to the mounting and guide member 36.

In accordance with a preferred form of the invention, and as best viewed in FIG. 5, the retaining plate 162 is also preferably coupled by a short flexible member or cable 166 to the receptacle 32. This retains plate or key 162 against loss, and readily accessible for use in mounting the receptacle 32 to the mounting and guide member 36 when desired. Since the receptacle is effectively coupled with the handle extension portion 42 by the previously mentioned cable 84, these parts generally form a conveniently detachable unit of the paint cart of the invention.

Moreover, the handle extension portion 42 will be seen to be a tubular member of generally greater diameter than the tubular part 40*a* of handle base portion 40. Hence, these two tubular members 42 and 40*a* interfit in telescoping fashion as indicated in FIGS. 1 through 3. In order to hold the handle extension portion 42 in place, a through aperture 170 is provided through one outer wall thereof at a generally lower portion thereof. Cooperatively, a retractable, projecting detent or pin member 172 is provided in an upper portion of tubular handle base portion 40*a* for releasably engaging through aperture 170. Hence, the unit formed by handle extension 42 and all of the parts attached thereto as previously described form a convenient unit, as best seen in FIG. 5, for partially disassembling the painting cart 20 and permitting the collapsing of member 36 and handle base portion 40 with respect thereto as previously described and as also shown in FIG. 5. Thereupon, the handle extension 42 and parts attached thereto as previously mentioned may also be conveniently placed upon the collapsed cart for transport or storage in the manner illustrated in FIG. 6.

Figure 4:
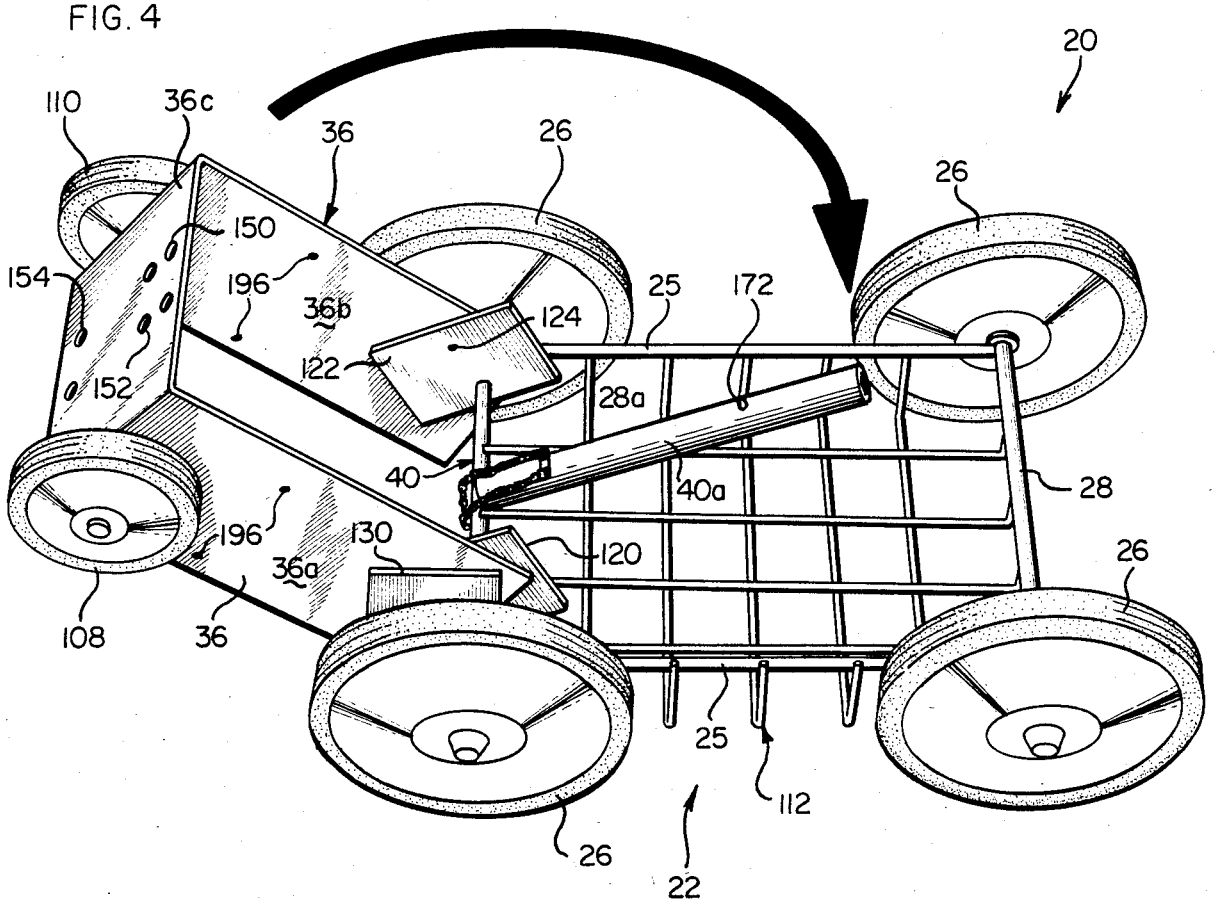
FIG. 4 is a top perspective view illustrating partial disassembly and partial collapsing of the collapsible painting cart of the invention.

In this regard, it will be now appreciated that FIG. 4 illustrates initial movement of the handle base portion 40 and the guide and mounting member 36 to the collapsed or stored position relative to the frame 22. FIG. 5 illustrates the fully collapsed or stored positions of handle base portion 40 and mounting and guide member 36 and the disassembly of the handle extension 42 and elements coupled therewith as described above. Finally, FIG. 6 illustrates the fully collapsed positions and placement of handle extension 42 and other elements coupled therewith with respect to the previously collapsed portions of the painting cart structure.

Referring now also to FIG. 8, and as also shown in FIGS. 5 and 6, an additional outrigger member or means 180 in the form of a generally flat plate member bent into a generally L-shaped configuration is provided. This outrigger means or member is selectively mountable to the mounting and guide member 36 to extend laterally outwardly of the wheels 26. This outrigger member comprises a second mounting and guide member for mounting the receptacle 32 for delivery of paint to surfaces laterally outwardly of the wheels 26. In this regard, the outrigger permits painting of floor or ground surfaces closely adjacent to or along side of a vertical wall or other vertical surface, that is, a surface which could not be painted with the spray can 34 mounted as generally shown in FIGS. 1 through 3. In this regard, the outrigger means or member 180 includes pairs of aligned through apertures 182, 184 and 186 which are generally similar to the aligned apertures 150, 152 and 154 of the first guide and mounting member 36. These latter apertures receive protruding members 156 and 158 and retaining member 162 is coupled therewith in the same fashion illustrated in FIG. 9 for mounting the receptacle 32 thereto.

Additionally, and in accordance with a further feature of the invention, the outrigger member 180 includes angular mounting means for mounting the receptacle means thereto at an angle relative to the side of the frame member 22, that is, at an acute angle relative to the floor or ground surface 46. Such angular mounting is indicated in phantom line in FIG. 8. As best viewed in FIG. 8, this angular mounting further permits painting of portions of an adjacent vertical surface 188 shown in phantom line, or of the corner formed between the surface 188 and the ground or floor surface 46. In the illustrated embodiment this angular mounting means comprises an additional through aperture 185 located substantially centered within an imaginary rectangle whose corners are defined by the two pairs of apertures 182 and 184. The distance between aperture 185 and either aperture of either of the pairs of apertures 182 and 184 is equal to the spacing of the projecting members 156 and 158 for mounting the receptacle member 32 as generally indicated in phantom line in FIG. 8. In this regard, it will be noted that two possible heights of such angular mounting are selectable, that is, with projections 156 and 158 engaged with apertures 182 and 185 or alternatively with apertures 184 and 185. In the latter, relatively elevated position, the container 34 may be suitably located so as to spray paint upon a surface elevated above the ground 46, or even an elevated horizontal surface 190 shown in phantom line in FIG. 8. This surface 190 and surface 188 may form a low curb, parking barrier or the like 192.

The outrigger 180, as previously mentioned, comprises a generally right-angle or L-shaped member provided by bending or otherwise forming a generally flat, sheet-like piece of material. Preferably this material is metallic and this bending or forming defines a mounting portion or surface 180*a* at generally right angles to the surface in which mounting apertures 182, etc. are formed. Preferably, a pair of externally threaded screw-type fasteners 194 are welded or otherwise affixed to this mounting portion or surface 180*a* (see FIG. 5). These fasteners 194 are spaced apart for interfitting with one or the other of two pairs of aligned through apertures 196 provided respectively on sidewalls 36*a* and 36*b* of the mounting and guide member 36. In this regard, mating internally threaded fasteners such as wing nuts 198 are provided for attaching outrigger 180 to member 36 in this fashion. Hence, the outrigger member 180 may selectively be employed to deposit paint laterally outwardly of the wheels 26 to either side of the frame 22. The outrigger member or second mounting and guide member 180 may also be readily placed in or upon the carrier 112 or frame member 22 for storage and transport as illustrated in FIG. 6.

Moreover, as illustrated in FIG. 7, the receptacle 32 may be mounted behind the front wall 36*a* of mounting and guide member 36, as well as in front thereof as illustrated in FIGS. 1 through 3. The mounting illustrated in FIGS. 1 through 3 may be preferable in instances where it is desired to apply the stripe or strip of paint 48 running relatively close up to a vertical wall or surface generally in front of the cart 20. However, the mounting illustrated in FIG. 7 may be preferable for outdoor use, since the walls 36*a* and 36*b* tend to protect the spray pattern 50 from being disturbed by wind or the like so as to maintain a relatively sharp stripe 48.

With respect to the described plurality of possible mountings of the receptacle 32 for directing paint in different directions or in different situations, it is noted that the mounting arrangement of the invention advantageously permits ready repositioning of the receptacle 32. That is, the retaining member or key 162 is relatively readily removed, permitting simple removal of projecting or locating members 156 and 158 from one selected pair of apertures and relocating thereof with respect to another pair of apertures to locate the receptacle member 32 and hence container spray can 34 as desired. Hence, the relatively simple and yet reliable mounting assembly or arrangement permits relative rapid and simple relocation of the container or spray can 34 for spraying or applying paint to various surfaces, as desired.

While particular embodiments of the invention have been shown and described in detail, it will be obvious to those skilled in the art that changes and modifications of the present invention may be made without departing from he invention in its broader aspects, some of which changes and modifications being matters of routine engineering or design, and others being apparent only after study. As such, the scope of the invention should not be limited by the particular embodiments and specific constructions described herein but should be defined by the appended claims and equivalents thereof. Accordingly, the aim in the appended claims is to cover all such changes and modifications as fall within the true spirit and scope of the invention.

The invention is claimed as follows:

1. A collapsible painting cart apparatus comprising: a mobile frame; receptacle means for receiving a container of paint; an extendable and retractable mounting and guide member for mounting said receptacle means and for guiding the direction of paint released form the container received by said receptacle means, said mounting and guide member being mounted to said frame for movement between a first position extended from said frame for applying paint to a desircd surface and a second position retracted within said frame for storage; and handle means attachable to said frame and extending upwardly therefrom for gripping by an operator to propel said mobile frame relative to said surface; wherein said mounting and guide member includes a pair of side walls and a front wall, and lid means for attaching the receptacle means to said front wall at varying heights, comprising, a pair of projections on said receptacle means and a plurality of pairs of apertures formed in said front wall and sized to receive said projections, such that said receptacle means can be mounted internally of said mounting and guide members between said side walls or exteriorly of said side walls.

2. Apparatus according to claim 1 wherein said handle means includes and extendable and retractable handle base portion mounted to said frame for movement between a working position extended relative to said frame and a storage position retracted for storage within said frame.

3. Apparatus according to claim 2 wherein said handle means includes a handle extension portion selectively mountable to said handle base portion when in its working position and terminating in grip means for gripping by an operator.

4. Apparatus according to claim 2 wherein said handle means is pivotally mounted to said mobile frame for movement between said working and storage positions.

5. Apparatus according to claim 1 and further including selectively actuatable paint release control means having a controller portion coupled with said receptacle means for controlling release of paint from a container received therein and an actuator portion operatively coupled with said controller portion and mountable to said handle means for selective actuation by said operator for causing said oontroller portion to initiate and terminate the release of paint from said container as desired.

6. Apparatus according to claim 5 wherein said controller portion is normally biased to a non-working position wherein paint is not released from said container thereby and is responsive to operation of said actuator portion for movement to a working position for releasing paint from said container.

7. Apparatus according to claim 1, further including means for mounting said receptacle laterally offset from said side walls, said means including an outrigger member which is selectively mountable to one or the othr of said side walls, and includes sets of pairs of said apertures for receiving the projections on said receptacle means.

8. Apparatus according to claim 1 wherein said mobile frame includes a plurality of wheels and a generally rectilinear frame member rotatably mounting said plurality of wheels; each of said wheels being mounted to said frame member to rotate substantially in a plane parallel with the plane of rotation of each other wheel for carrying said mobile frame in a substantially straight line in response to a propulsive force applied to said handle by an operator

9. Apparatus according to claim 8 wherein said mounting and guide member also mounts at least one wheel mounted thereto for rotation in a plane parallel to the planes of rotation of said mobile frame wheels.

10. Apparatus according to claim 1 wherein said mobile frame mounts carrier means for carrying a supply of said paint containers, said mounting and guide member being collapsible into said carrier means to facilitate storage and transport of said painting cart.

11. Apparatus according to claim 1 wherein said mounting and guide member is pivotally mounted to said mobile frame for movement between said first and second positions.

12. Apparatus according to claim 1 wherein said handle means and said mounting and guide member are both pivotally mounted about a common axis extending transversely across said mobile frame.

13. Apparatus according to claim 12 and further including an axle along said common axis which mounts a pair wheels at respective opposite ends thereof and to either side of said frame member.

14. Apparatus according to claim 12 and further including alignment means for holding said mounting and guide member and said handle means in a predetermined alignment relative to each other and to said frame member when said guide member is in the first position thereof.

15. Apparatus according to claim 1 wherein said mounting and guide member includes mounting means for mounting said receptacle means and a container received therein laterally intermediate the mobile frame periphery, with said container oriented for directing paint substantially vertically downwardly for depositing a stripe of paint of a selectable width as said cart is propelled in a substantially straight line, said mounting means including means for selecting said selectable width of said paint stripe.

16. Apparatus according to claim 15 wherein said selecting means of said mounting and guide member include a plurality of mounting apertures for mounting said receptacle at a plurality of different heights relative to a surface to be painted, for depositing a stripe of paint to said surface having a width correlative with the relative height at which said container is mounted.

17. A collapsible painting cart apparatus comprising: a mobile frame; receptacle means for receiving a container of paint; an extendable and retractable mounting and guide member for mounting said receptacle means and for guiding the direction of paint released from the container received by said receptacle means, said mounting and guide member being mounted to said frame for movement between a first position extended from said frame for applying paint to a desired surface and a second position retracted within said frame for storage; and handle means attachable to said frame and extending upwardly therefrom for gripping by an operator to propel said mobile frame relative to said surface; wherein said handle means and said mounting and guide member are both pivotally mounted about a common axis extending transversely across said mobile frame; and further including alignment means for holding said mounting guide member and said handle means in a predetermined alignment relative to each other and to said frame member when said guide member is in the first position thereof; and wherein said alignment means comprises alignable through apertures in predetermined surfaces of said frame member, of said mounting and guide means, and of said handle means, respectively; said predetermined surfaces being movable into a closely adjacent, facing relation for aligning said apertures upon pivotal movement of said mounting and guide means and said handle means respectively relative to said frame member, and pin means insertable through said through apertures when aligned, to define and maintain said predetermined alignment.

18. Apparatus according to claim 17 wherein said handle means comprises a base portion including a sleeve rotatably mounted to said axis and at least one plate member defining said predetermined surface of said handle means and coupled to an outer end of said sleeve and rotatable with said sleeve relative to said axis to a position closely adjacent said predetermined surfaces of said frame and of said mounting and guide member, said plate member having said through aperture thereon for alignment with the through apertures of said mounting and guide member and of said frame member, respectively.

19. Apparatus according to claim 18 wherein said pin means includes spaced apart stop means thereon for resisting forces tending to dislodge said pin means from said aligned through apertures once inserted therethrough.

20. Apparatus according to claim 19 wherein said spaced apart stop means comprises protruding, retractable detent means toward one end of said pin means and coupling means of greater dimension than the diameter of said through aligned apertures coupled near an opposite end thereof, and further including elongate flexible means coupled between said coupling means and said handle means to thereby retain said pin means against loss and readily accessible for insertion through said through aligned apertures.

21. A collapsible painting cart aparatus comprising a mobile frame; receptacle means for receiving a container of paint; an extendable and retractable mounting and guide member for mounitng said receptacle means and for guiding the direction of paint released from the container received by said receptacle means, said mounting and guide member being mounted to said frame for movement between a first position extended from said frame for applying paint to a desired surface and a second position retracted within said frame for storage; and handle means attachable to said frame and extending upwardly therefrom for gripping by an operator to propel said mobile frame relative to said surface; wherein said mobile frame inlcudes a plurality of wheels and a generally rectilinear frame member rotatably mounting said plurality of wheels; each of said wheels being mounted to said frame member to rotate substantially in a plane parallel with the plane of rotation of each other wheel for carrying said mobile frame in a substantially straight line in response to a propulsive force applied to said handle by an operator; and wherein whels are located adjacent opposite sides of said frame member, and further including outrigger means selectively mountable to said mounting and guide member extending laterally outwardly of said wheels to either side of said frame member for mounting said receptacle thereto for delivery of paint to surfaces laterally outwardly of either of said frame member sides and the associated wheels.

22. Apparatus according to claim 21 wherein said outrigger member includes means for selectively mounting said receptacle at a plurality of different heights.

23. A collapsible painting cart apparatus comprising: a mobile frame; receptacle means for receiving a container of paint; an extendable and retractable mounting and guide member for mounting said receptacle means and for guiding the direction of paint released from the container received by said receptacle means, said mounting and guide member being mounted to said frame for movement between a first position extended from said frame for applying paint to a desired surface and a second position retracted within said frame for storage; and handle means attachable to said frame and extending upwardly thereform for gripping by an operator to propel said mobile frame relative to said surface; wherein said mounting and guide member includes mounting means for mounting said receptacle means and a container received therein laterally intermediate the mobile frame periphery, with said container oriented for directing paint substantially vertically downwardly for depositing a stripe of paint of a selectable width as said cart is propelled in a substantially straight line, said mounting means including means for selecting said selectable width of said paint stripe; and further including outrigger means selectively mountable to said mounting and guide member extending laterally outwardly thereof to either side of said frame member for mounting said receptacle thereto for delivery of paint to surfaces laterally outwardly of either of said frame member sides, and angular mounting means on said outrigger means for mounting said receptacle means thereto at an acute angle relative to said side surface of said frame member to thereby additionally apply paint to at least portions of vertical surfaces laterally outwardly of said frame member.

24. Apparatus according to claim 23 wherein said angular mounting means comprises means for mounting said receptacle means at a plurality of heights as well as at an acute angle.

* * * * *